US006065439A

United States Patent [19]

Achenbach et al.

[11] Patent Number: 6,065,439

[45] Date of Patent: May 23, 2000

[54] INTERNAL COMBUSTION ENGINE

[75] Inventors: Karl-Jörg Achenbach, Biedenkopf; Ulrich Bertsch, Burgstetten; Thomas Hardt, Weinstadt; Hubert Schnüpke; Günther Zoll, both of Stuttgart, all of Germany

[73] Assignee: Daimler Chrysler AG, Stuttgart, Germany

[21] Appl. No.: 09/299,236

[22] Filed: Apr. 23, 1999

[30] Foreign Application Priority Data

Apr. 25, 1998 [DE] Germany ..... 198 18 592

[51] Int. Cl.[7] ..... F02B 77/00

[52] U.S. Cl. ..... 123/198 E; 181/204

[58] Field of Search ..... 123/195 R, 195 C, 123/195 E, 90.38; 181/204

[56] References Cited

U.S. PATENT DOCUMENTS

| | | | |
|---|---|---|---|
| 4,446,827 | 5/1984 | Kubozuka . | |
| 4,867,335 | 9/1989 | Segal | 123/198 E |
| 4,977,870 | 12/1990 | Hashimoto et al. | 123/198 E |
| 5,000,142 | 3/1991 | Aruga et al. | 123/198 E |
| 5,245,961 | 9/1993 | Miyakubo et al. | 123/198 E |
| 5,640,937 | 6/1997 | Slopsema | 123/198 E |
| 6,009,898 | 1/2000 | Risch et al. | 123/198 E |

FOREIGN PATENT DOCUMENTS

| | | |
|---|---|---|
| 38 23 107 | 3/1989 | Germany . |
| 195 11 864 | 7/1996 | Germany . |
| 2 140 502 | 11/1984 | United Kingdom . |

*Primary Examiner*—John Kwon
*Attorney, Agent, or Firm*—Klaus J. Bach

[57] ABSTRACT

In an internal combustion engine with an engine block, a cylinder head with a camshaft mounted on the engine block, a crankshaft mounted on the engine block opposite the cylinder head and a camshaft timing drive interconnecting the crankshaft and the camshaft, a camshaft timing drive enclosure is disposed at one end of the engine and fully encloses the camshaft timing drive, and the enclosure has extensions extending over the side walls of the engine block and covering openings formed in the side walls of the engine block providing for a light-weight arrangement with noise attenuating properties.

3 Claims, 2 Drawing Sheets

INTERNAL COMBUSTION ENGINE

BACKGROUND OF THE INVENTION

The invention relates to an internal combustion engine including an engine block with an upper flange surface having a cylinder head with a camshaft disposed thereon, a lower flange surface for mounting an oil pan thereto, and a front end with an enclosure for receiving a camshaft drive arrangement.

In a known internal combustion engine of this type (DE 195 11 864 C), the enclosure receiving the camshaft drive arrangement is formed by wall portions which project from the engine block end walls and on which a cover is mounted.

It is the object of the present invention to provide an engine with an enclosure for receiving the camshaft drive arrangement which is light-weight and which reduces the emission of noises generated by the camshaft drive.

SUMMARY OF THE INVENTION

In an internal combustion engine with an engine block, a cylinder head with a camshaft mounted on the engine block, a crankshaft mounted on the engine block opposite the cylinder head and a camshaft timing drive interconnecting the crankshaft and the camshaft, a timing drive enclosure is disposed at one end of the engine and fully encloses the timing drive, and the enclosure has extensions extending over the side walls of the engine block and covering openings formed in the side walls of the engine block providing for a light-weight arrangement with noise attenuating properties.

The openings in the side walls of the engine block and the construction of the enclosure walls forming the space for the camshaft timing drive structure from a plastic material results in a substantial weight reduction. Covering the openings by the extensions of the plastic enclosure walls and the enclosure of the camshaft drive by plastic walls furthermore results in a substantial reduction of the emission of noises from the internal combustion engine. This is particularly important if the camshaft drive is a chain drive.

The oil pan may extend longitudinally up to below the chamber receiving the camshaft drive and may include a flange surface by which it is joined to the drive enclosure. Alternatively, the flange surface may be provided on an extension of the engine block which extends below the drive chamber enclosure as it is shown for example in DE 195 11 864 C.

An embodiment of the invention will be described below in greater detail on the basis of the accompanying drawings.

DESCRIPTION OF A PREFERRED EMBODIMENT

Figure 1:
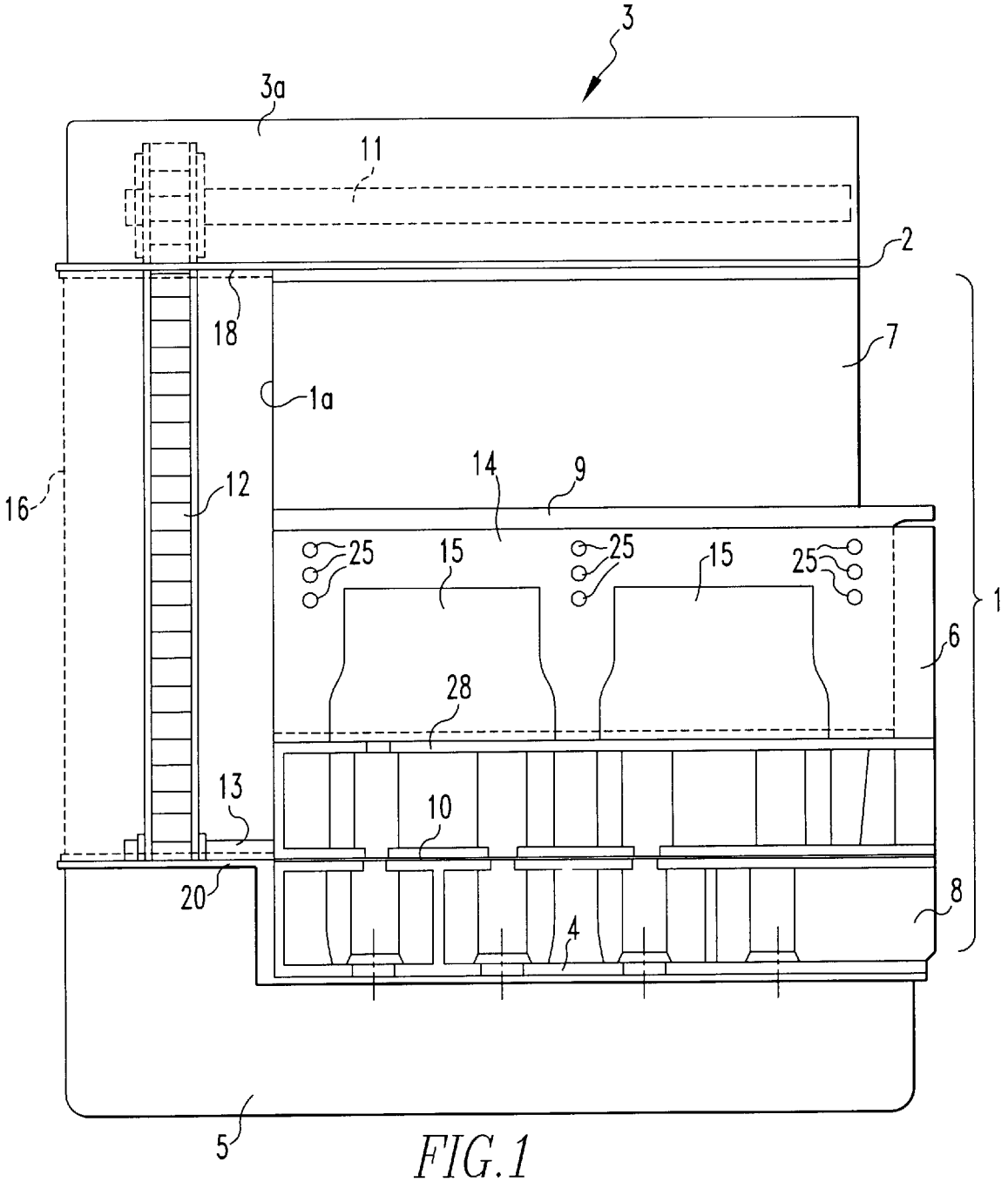
FIG. 1 is a schematic side view of an internal combustion engine without the camshaft drive enclosure.

The internal combustion engine shown in FIG. 1 includes an engine block 1 having an upper flange surface 2 on which a cylinder head 3 is mounted and a lower flange surface 4 on which an oil pan 5 is mounted. The engine block 1 comprises, in one embodiment, a separate crank case 6 with a flange 9 on which a cylinder block 7 is disposed and a lower part 8 which is mounted to the bottom flange 10 of the crankcase 6. However, the crankcase 6, the cylinder block 7 and the lower part 8 may be formed integrally as an engine block as shown for example in DE 195 11 864 C. The cylinder head 3 includes a camshaft 11, which is driven by the crank shaft 13 by way of a camshaft timing drive disposed at the front end of the engine block 1, the camshaft timing drive shown in FIG. 1 being a timing chain 12.

The two side walls 14 of the crank case 6 of which only one is visible in FIG. 1 include large-size openings 15 for reducing the weight of the engine.

Figure 2:
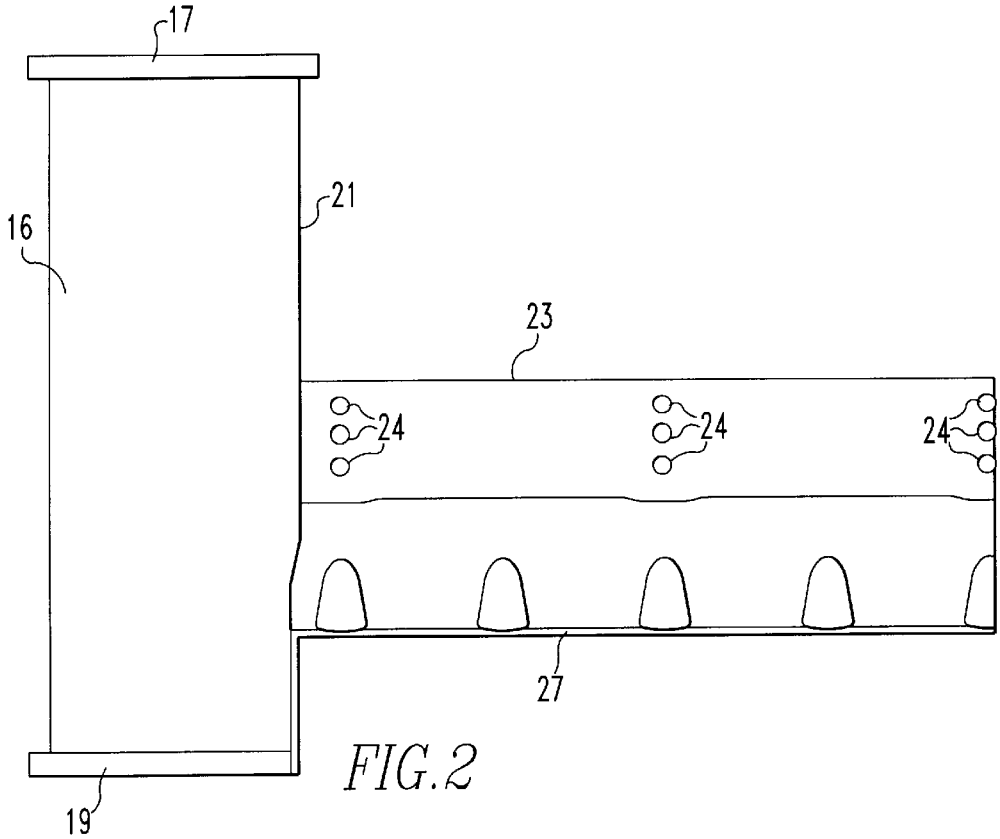
FIG. 2 is a side view of the camshaft drive enclosure with side extensions covering the openings in the side walls of the engine block.
Figure 3:
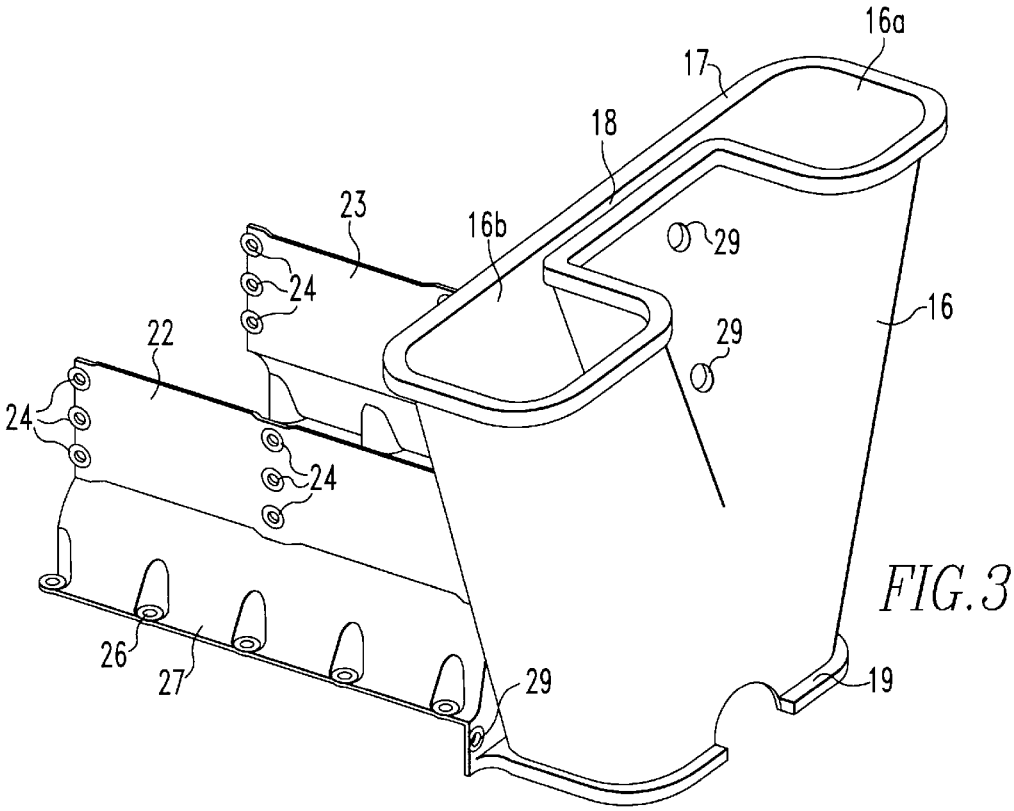
FIG. 3 is a perspective view of the camshaft drive enclosure.

The camshaft timing chain 12 is disposed at the front end of the engine block 1 in an enclosure 16, which is shown in FIG. 1 by a dashed line, but which is shown in detail in FIGS. 2 and 3. The enclosure 16 is an integrally formed hollow body which consists of a plastic material and which is open upwardly toward the cylinder head 3 and downwardly toward the oil pan 5. The timing drive enclosure 16 includes an upper flange 17 which cooperates with a flange 18 on the cover 3*a* of the cylinder head 3 and a lower flange 19 to which the oil pan 5 is mounted by way of its flange 20. The oil pan 5 extends below the timing drive enclosure 16 to which it is connected. The enclosure 16 has plate-like extensions 22, 23, which extend over the sides of the engine block 1 and cover the openings 15 in the side walls 14, when the enclosure 16 is mounted on the engine block 1.

The enclosure 16 has two partial chambers 16*a* and 16*b* in which the two lobes of the timing chain 12 are received. As apparent from the drawing, the timing chain is fully enclosed by the timing drive enclosure 16. Preferably, the timing drive enclosure 16 also includes a rear wall 21 disposed adjacent the engine block in order to reduce the timing drive noise emissions as much as possible.

For mounting the timing enclosure 16 to the engine block 1, the extensions 22 and 23 are provided with bores 24, which are in axial alignment with threaded openings 25 in the side walls 14 of the engine block 1. The enclosure 16 further includes bores 26 in a flange 27, which are in axial alignment with threaded openings in a flange 28 in the engine block 1 disposed below the openings 15. Furthermore, the timing drive enclosure 16 is provided, between the partial chambers 16*a* and 16*b* and at its lower edge, with bores 29 through which screws are inserted whereby the enclosure 16 is also mounted to the front wall 1*a* of the engine block 1.

The weight reduction achieved by the openings 15 in the engine block and by the enclosure 16 consisting of a plastic material is substantial. Since all the openings 15 are covered by parts of a single component, that is, the timing drive enclosure, the manufacture and the assembly of the component is relatively simple. Furthermore, noise emissions from the engine, that is, the openings 15, and particularly the timing drive are reduced since the cover structure consists of plastic material, which acts as sound insulation.

Between the flange surfaces 17, 18 and 19, 20 as well as 27, 28 gaskets may be disposed.

Instead of being mounted to the engine block by screws the timing drive enclosure may be cemented or clamped to the engine block.

In the embodiment described and shown herein, the oil pan 5 extends below the timing drive enclosure 16 and the flange 19 of the enclosure 16 is disposed on the flange 20 of the oil pan 5. However, alternatively, the crankcase 6 may extend forwardly below the timing drive enclosure 16 and the timing drive enclosure may have a bottom wall with an opening providing for communication between the interior of the timing drive enclosure and the oil pan 5.

What is claimed is:

1. An internal combustion engine comprising an engine block having end walls and side walls with upper and lower flange surfaces, a cylinder head with a camshaft mounted on said upper flange surface, an oil pan mounted on said lower flange surface, a crankshaft mounted on said engine block, a camshaft timing drive disposed at one end of said engine block and drivingly interconnecting said crankshaft and said camshaft, and a camshaft timing drive enclosure of plastic material disposed at said one end of said engine block and enclosing said camshaft timing drive, said engine block having openings in its side walls and said timing drive enclosure having extensions extending along the side walls of said engine block so as to cover said openings and being mounted to said engine block.

2. An internal combustion engine according to claim 1, wherein said camshaft timing drive enclosure fully encloses said camshaft timing drive in the area adjacent said engine block.

3. An internal combustion engine according to claim 1, wherein said cylinder head includes a cover projecting over said camshaft timing drive enclosure and said oil pan projects beyond said engine block below said camshaft timing drive enclosure, and said timing drive enclosure is disposed between said oil pan and said cylinder head cover.

* * * * *